US006774744B1

(12) United States Patent
Hattori et al.

(10) Patent No.: US 6,774,744 B1
(45) Date of Patent: Aug. 10, 2004

(54) DIELECTRIC FILTER, DIELECTRIC DUPLEXER, AND COMMUNICATION DEVICE

(75) Inventors: Jun Hattori, Takatsuki (JP); Kazuhiko Kubota, Mukou (JP); Hiroyuki Kubo, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/512,859

(22) Filed: Feb. 24, 2000

(30) Foreign Application Priority Data

Feb. 25, 1999 (JP) ..... 11-047942

(51) Int. Cl.[7] ..... H01P 5/12; H01P 1/20; H01P 7/10

(52) U.S. Cl. ..... 333/134; 333/202; 333/219.1

(58) Field of Search ..... 330/202, 219.1, 330/134

(56) References Cited

U.S. PATENT DOCUMENTS 4,623,857 A * 11/1986 Nishikawa et al. ..... 333/219
5,783,979 A * 7/1998 Andoh et al. ..... 333/202
5,831,496 A * 11/1998 Sonoda et al. ..... 333/202
5,898,349 A * 4/1999 Hattori et al. ..... 333/219.1

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric filter that has attenuation poles on both the low frequency side and the high frequency side of its pass band, without using two dielectric resonators. The dielectric filter includes a cavity in which a conductive layer is formed, and a cross-shaped dielectric resonator disposed within the cavity, the dielectric resonator having at least three resonant modes, and coupling loops being coupled to the dielectric resonator. A coupling loop couples to a resonant mode at a first stage, among the resonant modes of the dielectric resonator, and also couples to resonant mode at a third stage in approximately negative-phase with respect to the first stage.

14 Claims, 6 Drawing Sheets

DIELECTRIC FILTER, DIELECTRIC DUPLEXER, AND COMMUNICATION DEVICE

BACKGROUND OF THE INVENTION

1. Field of the Invention

The present invention relates to a high-frequency filter, and more particularly to a dielectric filter, a dielectric duplexer, and a communication device, which are used in a base station of a microwave band communication system.

2. Description of the Related Art

A first example of a conventional dielectric filter will be described with reference to FIG. 1.

The dielectric filter 110 is constituted of two dielectric resonators 120*a,* 120*b* arranged in parallel, and metallic panels 111*a,* 111*b* for covering the opening parts of the dielectric resonators 120*a,* 120*b*. Each of the dielectric resonators 120*a,* 120*b* is constituted of a rectangular-prism-shaped cavity 121 made of a dielectric ceramic, and a dielectric block 122 disposed within the cavity 121. A conductive layer 123 is formed by painting and baking a silver paste on an outside surface of the cavity 121. The dielectric block 122 has a cross-shape in which two dielectric poles are intersected. Typically, the cavity 121 and the cross-shaped dielectric resonator 122 are integrally molded. Coupling loops 112*a,* 112*b* are mounted to the metallic panel 111*a*. One end of each loop is connected to a central conductor of a coaxial connector 113*a,* 113*b* mounted to the metallic panel 111*a,* and the other end thereof is grounded by being connected to the metallic panel 111*a*. Further, a coupling loop 112*c* for electromagnetic-coupling the two dielectric resonators 120*a,* 120*b* is mounted to the other metallic panel 111*b*.

When a signal is inputted from an outside, a magnetic field is generated in the area surrounding the loop 112*a,* and the generated magnetic field couples to a magnetic field surrounding one of the dielectric poles in the dielectric block 122. Further, an electromagnetic field around the one of the dielectric poles and an electromagnetic field around the other one of the dielectric poles that is perpendicular thereto are coupled by a groove 125 formed at the intersection of the two dielectric poles of the dielectric block 122. For the other dielectric resonator 120*b,* a similar chain of electromagnetic field couplings occurs, and as a result, the dielectric filter 110 functions as a fourth order band pass filter.

The loop 112*a* is constituted of a first part 112*a*1 that extends in a direction that is the same as a length direction of one of the dielectric poles, and a second part 112*a*2 that extends in a direction perpendicular to the first part 112*a*1. The loop 112*b* has a similar structure. Consequently, the first part 112*a*1 of the loop 112*a* couples to one of the dielectric poles extending in the same direction of the dielectric block 122, and at the same time the second part 112*a*2 of the loop 112*a* couples to the other one of the dielectric poles in the dielectric block 122. As such, it is possible to provide an attenuation pole on either a low frequency side or a high frequency side of the resonant frequency of the dielectric resonator, by electromagnetic-coupling the loop 112*a* to the first and second resonators formed by the respective dielectric poles in the dielectric resonator 120*a* simultaneously.

In general, for a signal with a frequency lower than a resonant frequency, its phase will not change even when passing through a resonator, but for a signal with a frequency higher than the resonant frequency, its phase will change by π when passing through the resonator. For example, when coupling to an in-phase resonant mode that occurs in one of the dielectric poles corresponding to the first part 112*a*1 of the loop 112*a,* and coupling to a reversed-phase resonant mode that occurs in the other one of the dielectric poles corresponding to the second part 112*a*2 of the loop 112*a,* an attenuation pole is generated on the low frequency side of the resonant frequency similarly.

A second example of a conventional dielectric filter will be described with reference to FIG. 2. FIG. 2 is a perspective view of a dielectric filter according to a second conventional example. Moreover, the identical symbols are attached to the same parts as in the previous conventional example, and it will be illustrated by showing only the dielectric resonator that constitutes the dielectric filter.

In the conventional dielectric resonator 120*c* shown in FIG. 2, dent parts 124 are formed in an outside of the cavity 121 extending toward an inside thereof, at the four points where the cross-shaped dielectric resonator 122 joins the cavity 121. As a result, the dielectric resonator 120*c* has three resonant modes, i.e., TM110 mode, TM111 mode, and TM110 mode at respective parts thereof, similar to those shown in the electric field distribution diagram of FIG. 4, and the dielectric filter functions as a three-stage band pass filter.

Because several spurious modes are generated outside the pass band, it is necessary in a dielectric filter used in a communication base station, and the like, to provide attenuation poles both on the low frequency side and on the high frequency side of the pass band in order to restrain them. However, in the dielectric filter in the first conventional example, with the dielectric resonator having two resonant modes, and the loop providing input/output (I/O) coupling for these two resonant modes simultaneously, an attenuation pole can be provided on either the low frequency side or the high frequency side, but not both. Accordingly, in order to provide the attenuation poles both on the high frequency side and on the low frequency side, it is necessary to arrange one additional dielectric resonator in parallel, in order to provide the attenuation pole on the other side. That is, in the first conventional example, for providing the attenuation poles on the low frequency side and on the high frequency side, two dielectric resonators are always required, and thus there is a problem of increasing the size of the dielectric filter.

Further, in the dielectric filter in the second conventional example, there is no way to provide attenuation poles on both the low side and the high side of the resonant frequency band.

SUMMARY OF THE INVENTION

Accordingly, it is an object of the present invention to provide a dielectric filter, which solves these problems, which provides attenuation poles on the low frequency side and on the high frequency side of the resonant frequency, and which is capable of being miniaturized.

These and other objects of the present invention can be achieved by a dielectric filter according to a first aspect of the invention, including a dielectric resonator having at least three resonant modes, and configured including a conductive cavity, and a dielectric resonator arranged within the cavity, and an input/output coupling unit that couples to the dielectric resonator, wherein the input/output coupling unit couples to a resonant mode at the first stage, as well as to at least one resonant mode at the h-th stage (h=2n+1: where n is an integer) approximately in negative-phase with respect to the first stage, among the resonant modes of the dielectric resonator.

The objects of the present invention can also be achieved by a dielectric filter according to a second aspect of the invention, including a dielectric resonator having at least three resonant modes, and configured including a conductive cavity, and a dielectric resonator arranged within the cavity and an input/output coupling unit that couples to the dielectric resonator, wherein the input/output coupling unit couples to a resonant mode at the last stage, as well as to at least one resonant mode at the (k−2n)-th stage (where n is an integer), the last stage being the k-th stage, approximately in negative-phase with respect to the last stage, among the resonant modes of the dielectric resonator.

In the dielectric filter according to the foregoing first and second aspects of the invention, preferably the input/output coupling unit is a loop having conductivity, and the input/output coupling unit is arranged in a direction such that it is coupled approximately in negative-phase with respect to a resonant mode to which the input/output coupling unit couples.

It is another object of the present invention to provide a dielectric duplexer which solves these problems, which provides attenuation poles on the low frequency side and on the high frequency side of the resonant frequency, and which is capable of being miniaturized.

The object of the present invention can also be achieved by a dielectric duplexer, including at least two dielectric filters, an input/output coupling unit coupling to each of the dielectric filters, respectively, and a unit for use in connecting to an antenna that is commonly connected to the dielectric filters, wherein at least one of the dielectric filters is a dielectric filter according to either one of the first and second aspects of the invention.

In the dielectric duplexer described above, it is preferable that the input/output coupling unit is a loop having conductivity, and each input/output coupling unit is arranged in a direction such that it is coupled approximately in negative-phase with respect to a resonant mode of the corresponding dielectric resonator to which the input/output coupling unit couples.

It is another object of the present invention to provide a communication device which solves these problems, which provides attenuation poles on the low frequency side and on the high frequency side of the resonant frequency, and which is capable of being miniaturized.

The object of the present invention can be achieved by a communication device, including a dielectric duplexer, a circuit for use in transmitting that is connected to one of the input/output coupling units of the dielectric duplexer, a circuit for use in receiving that is connected to another one of the input/output coupling units, and an antenna for being connected to the unit for use in connecting to an antenna of the dielectric duplexer, and including the dielectric duplexer and preferably the input/output coupling units described above.

For a signal with a frequency lower than a resonant frequency, its phase does not change when passing through a resonator, but for a signal with a frequency higher than the resonant frequency, its phase changes by $\pi$ as it passes through the resonator. Accordingly, when passing through a route such as a first stage, a second stage, a third stage, and so on, sequentially, at the h-th stage the signal is as if it has passed through the even numbered resonator, so that the phase of a signal in the resonant mode at the h-th stage is in-phase with the signal at the coupling location at the first stage for both a signal with a frequency lower than the resonant frequency and a signal with a frequency higher than the resonant frequency. On the other hand, in the other one of the routes, i.e., a route having coupling to the resonant mode at the h-th stage directly from the input/output coupling unit, the signal at the h-th stage is in negative-phase with respect to the phase of the signal at the first stage. That is, according to the dielectric filter of the present invention, the signals on the low frequency side and on the high frequency side of the resonant frequency are in negative-phase at the h-th stage, and thus it is possible to provide attenuation poles on the low frequency side and on the high frequency side of the resonant frequency with one dielectric resonator.

In another arrangement, which is similar to the previous one, at the last stage the signals on the low frequency side and on the high frequency side of the resonant frequency are in negative-phase, thereby making it possible to provide attenuation poles on the low frequency side and on the high frequency side of the resonant frequency with one dielectric resonator. Accordingly, by combining the dielectric filters as described above, it is possible to provide two or more attenuation poles on the low frequency side and on the high frequency side of the resonant frequency, respectively.

Furthermore, the dielectric filter according to the present invention is preferably such that the input/output coupling unit is a loop having conductivity, and the input/output coupling unit is arranged in a direction such that it is coupled in an approximately negative-phase with respect to a resonant mode to which the input/output coupling unit couples.

As a result, by changing only the arrangement direction of the loop, it is possible to couple to the resonant modes at the first and the h-th stages, or to the resonant modes at the last and the (k−2n) stages in negative-phase, respectively.

Moreover, the dielectric duplexer of the present invention includes at least two dielectric filters, an input/output coupling unit coupling to each of the dielectric filters, respectively, and a unit for use in connecting to an antenna that is commonly connected to the dielectric filters, wherein at least one of the dielectric filters is a dielectric filter as described above.

Furthermore, the communication device of the present invention includes a dielectric duplexer as described above, a circuit for use in transmitting that is connected to at least one of the input/output coupling units of the dielectric duplexer, a circuit for use in receiving that is connected to at least another one of the input/output coupling units, and an antenna for being connected to a unit for use in connecting to an antenna of the dielectric duplexer.

As a result, attenuation poles are provided on the low frequency side and on the high frequency side of the band, thereby enabling the dielectric duplexer, and the communication device, to have excellent characteristics.

Other features and advantages of the invention will be understood from the following description of embodiments thereof, in conjunction with the drawings, in which like references denote like elements and parts.

BRIEF DESCRIPTION OF THE DRAWINGS

Further objects and advantages of the invention can be more fully understood from the following detailed description taken in conjunction with the accompanying drawings in which.

DESCRIPTION OF EMBODIMENTS OF THE INVENTION

In the following, a dielectric filter that is an embodiment of the present invention will be described with reference to FIG. 3. Herein, FIG. 3 is an exploded perspective view of the dielectric filter according to the present embodiment.

Figure 1:
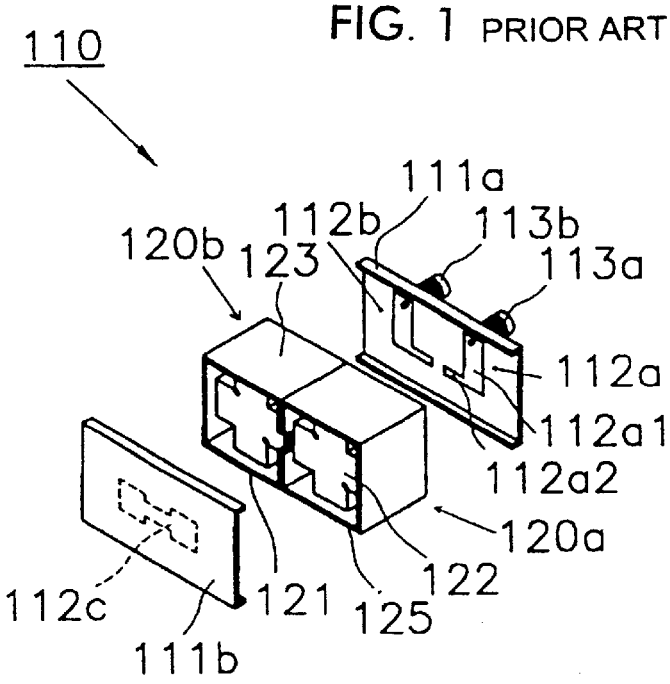
FIG. 1 PRIOR ART
FIG. 1 is an exploded perspective view of a conventional dielectric filter.
Figure 2:
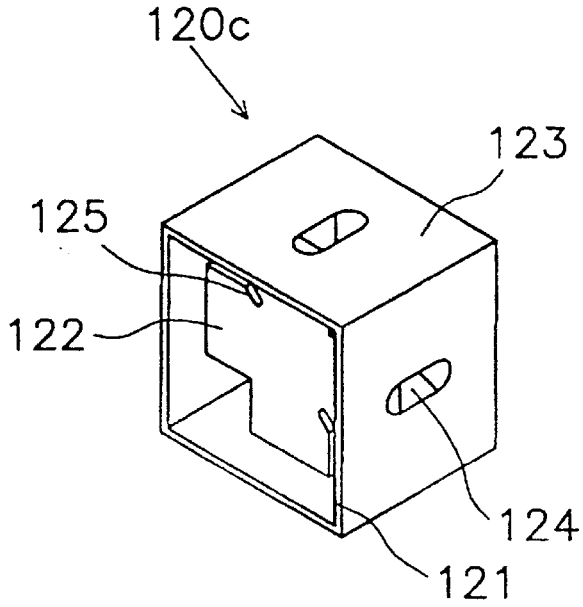
FIG. 2 PRIOR ART
FIG. 2 is a perspective view of another conventional dielectric resonator.
Figure 3:
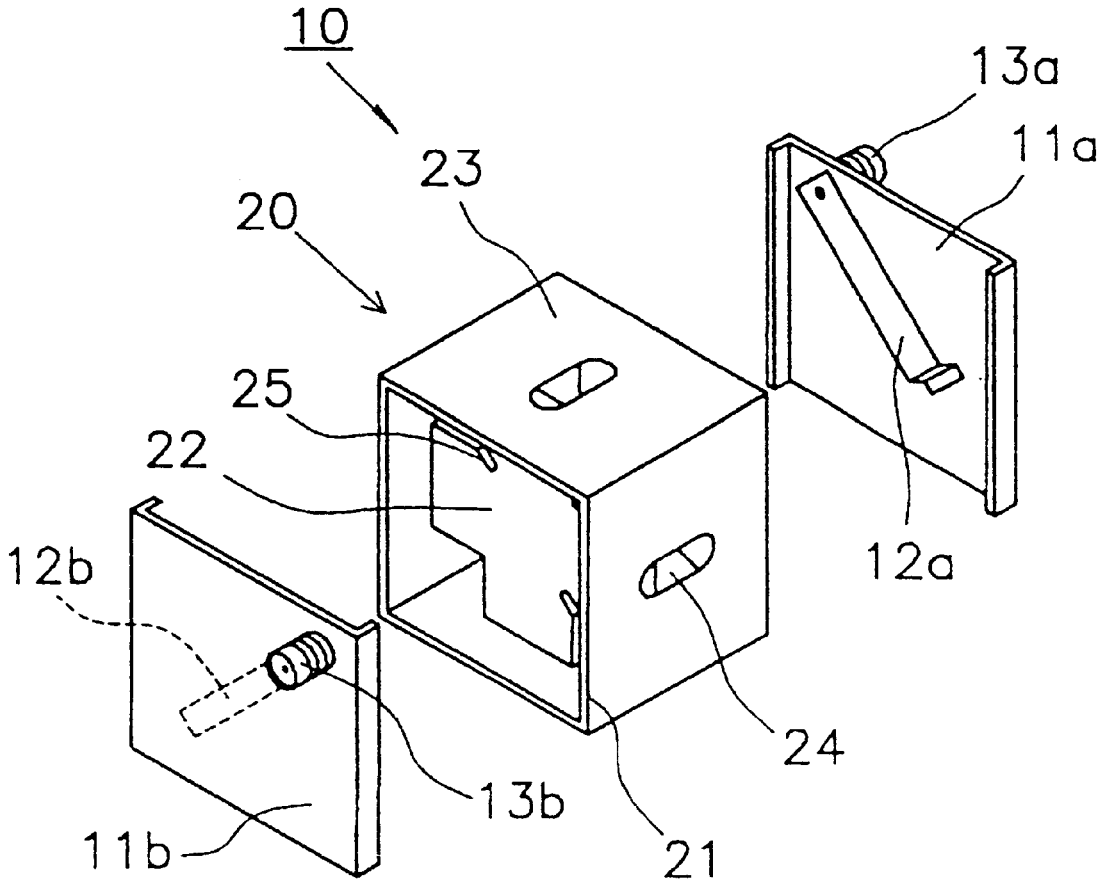
FIG. 3 is an exploded perspective view of a dielectric filter according to an embodiment of the present invention.
Figure 4:
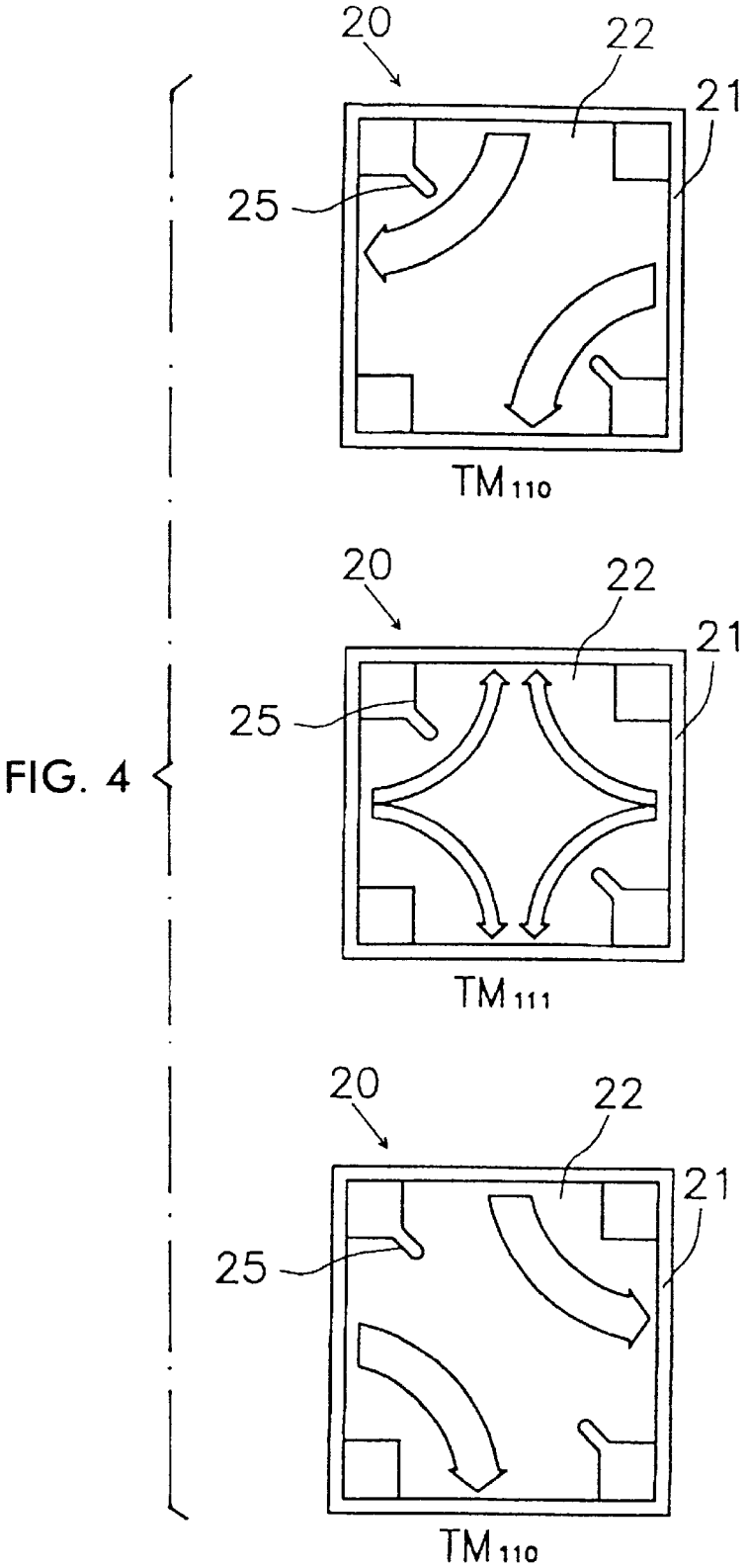
FIG. 4 is a plan view showing three resonant modes of the dielectric resonator of FIG. 3.

As shown in FIG. 3 the dielectric filter 10 according to the present embodiment is constituted of a dielectric resonator 20, and metallic panels 11*a,* 11*b* that are mounted so as to cover the opening parts of the dielectric resonator 20. The dielectric resonator 20 is constituted of a rectangular-prism-shaped cavity 21, and a cross-shaped dielectric resonator 22 disposed within the cavity 21. A conductive layer 23 is formed by painting and baking a silver paste on an outer surface of the cavity 21. Further, dent parts 24 are provided, penetrating from an outside of the cavity 21 toward an inside thereof, at four points where the cross-shaped dielectric resonator 22 joins the cavity 21. As a result, the dielectric resonator 10 functions as a three-stage band pass filter having three resonant modes, i.e., a $TM_{110}$ mode as a resonant mode at a first stage, a $TM_{111}$ mode as a resonant mode at a second stage, and $TM_{110}$ mode as a resonant mode at a third stage, as shown in the electric field distribution diagram of FIG. 4. In addition, the $TM_{110}$ mode at the first stage and the $TM_{110}$ mode at the third stage cross each other at right angles. Coupling loops 12*a,* 12*b* are mounted to the metallic panels 11*a,* 11*b*. First ends of the loops 12*a,* 12*b* are connected to central conductors of the coaxial connectors 13*a,* 13*b* mounted to the metallic panels 11*a,* 11*b*. The second ends of the loops 12*a,* 12*b* are grounded by being connected to the metallic panels 11*a,* 11*b*.

Figure 5:
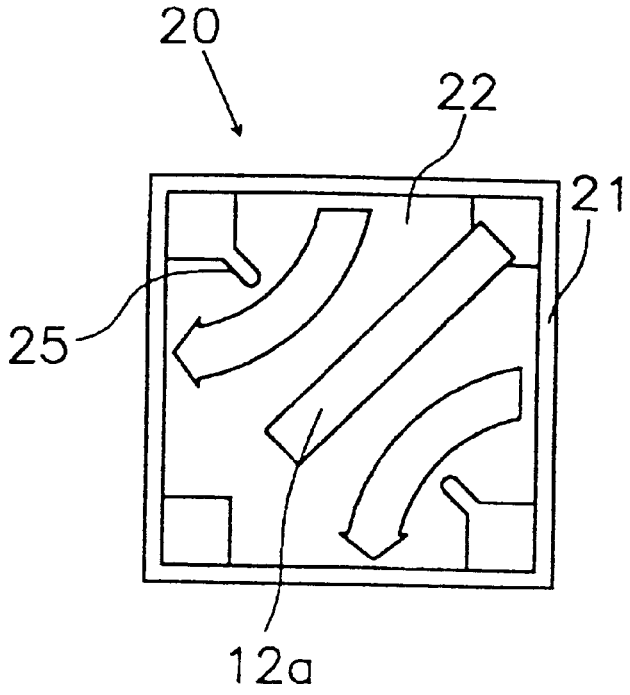
FIG. 5 is a plan view showing a mounting location of a coupling loop in a fundamental dielectric filter.

Fundamentally, the loop 12*a* forms an input/output (I/O) coupling. As shown in the plan view of FIG. 5, the loop 12*a* is arranged in a direction at 45°, assuming a bottom surface of the cavity 21 to be arranged at 0°. That is, the loop 12*a* is arranged in the same direction as an electric field direction of the resonant mode at the first stage so as to couple to the resonant mode at the first stage, whereby the loop 12*a* and the resonant mode at the first stage are magnetic-coupled.

Figure 6:
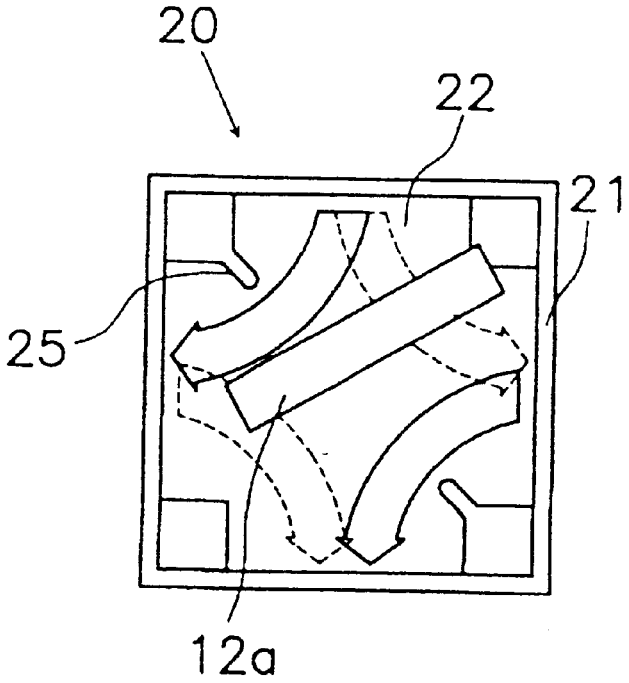
FIG. 6 is a plan view showing a mounting location of a coupling loop in the dielectric filter according to the present embodiment.

However, as shown in the plan view of FIG. 6, the loop 12*a* in the present embodiment is tilted toward the bottom surface of the cavity 21 from the electric field direction of the resonant mode at the first stage (i.e., less than 45°). In FIG. 6, the resonant modes at the first stage and the third stage are shown as being superimposed, and the first stage is shown in solid lines while the third stage is shown in dotted lines. By arranging the loop 12*a* in such direction, the loop 12*a* is turned to a position in which it couples to both the resonant mode at the first stage, and the resonant mode at the third stage that is perpendicular thereto. Further, because at the first stage and at the third stage the respective senses of the magnetic fields with respect to the loop 12*a* are opposite each other, the induced current vectors are in the opposite directions, whereby they are coupled in the opposite phases at the first stage and at the third stage.

Further, by modifying a mounting angle of the loop 12*a,* it is possible to adjust a coupling degree of the loop 12*a* and the resonant mode at the first stage, as well as a coupling degree of the loop 12*a* and the resonant mode at the third stage. That is, if the direction of the loop 12*a* is closer to the electric field direction in the resonant mode at the first stage, the degree of coupling to the first stage becomes stronger, and if it is away from the electric field direction in the resonant mode at the first stage, the degree of coupling to the resonant mode at the third stage becomes stronger. Moreover, the coupling to the resonant modes at both the first stage and at the third stage can be made stronger, by elongating a width or a length of the loop 12*a* or by bringing the loop 12*a* closer to the dielectric resonator 22.

Moreover, the three resonant modes of the dielectric resonator 20 are such that the resonant mode at the first stage, the resonant mode at the second stage, and the resonant mode at the third stage are coupled in sequence, by providing the groove 25 in the part where the two dielectric poles intersect in the cross-shaped dielectric resonator 22, or by forming in the intersection part a hole (not shown herein) at a predetermined location.

With such configuration, a signal that is inputted to an input/output (I/O) coupling, namely the loop 12*a,* on the one hand, passes through the first stage, the second stage, and the third stage, and on the other hand, directly couples to the resonant mode at the third stage via the loop 12*a,* in the phase opposite to that of the coupling to the first stage.

Since a signal that has passed through the first route turns to be as if having passed through two resonators, the phase at a location in the third stage will be in-phase with an initial phase at a frequency lower than the resonant frequency, and it will be changed by $2\pi$ with respect to the initial phase, i.e., it will be in-phase with the initial phase, at a frequency higher than the resonant frequency.

For a signal that has passed through the second route, since the phase in the location at the third stage is coupled so as to be in the opposite phase with respect to the phase at the first stage, it will be negative-phase with respect to the initial phase at frequencies both lower and higher than the resonant frequency. That is, signals both on the low frequency side and on the high frequency side of the resonant frequency at the third stage are cancelled out as being negative-phase, whereby attenuation poles are generated on the low frequency side and on the high frequency side of the resonant frequency.

In the filter that is described above, the signal that is inputted couples to the loop 12*b* mounted to the other metallic panel 11*b* in the direction that is the same as the electric field direction of the resonant mode at the third stage, and is outputted through the other coaxial connector 13*b,* and the dielectric filter 20 functions as a three-stage band pass filter.

According to the present embodiment, it is possible to provide attenuation poles on the low frequency side and on the high frequency side of the resonant frequency with only one dielectric resonator 20 having three resonant modes, thereby obtaining a dielectric filter in a miniature size and satisfying the required characteristics.

Figure 7:
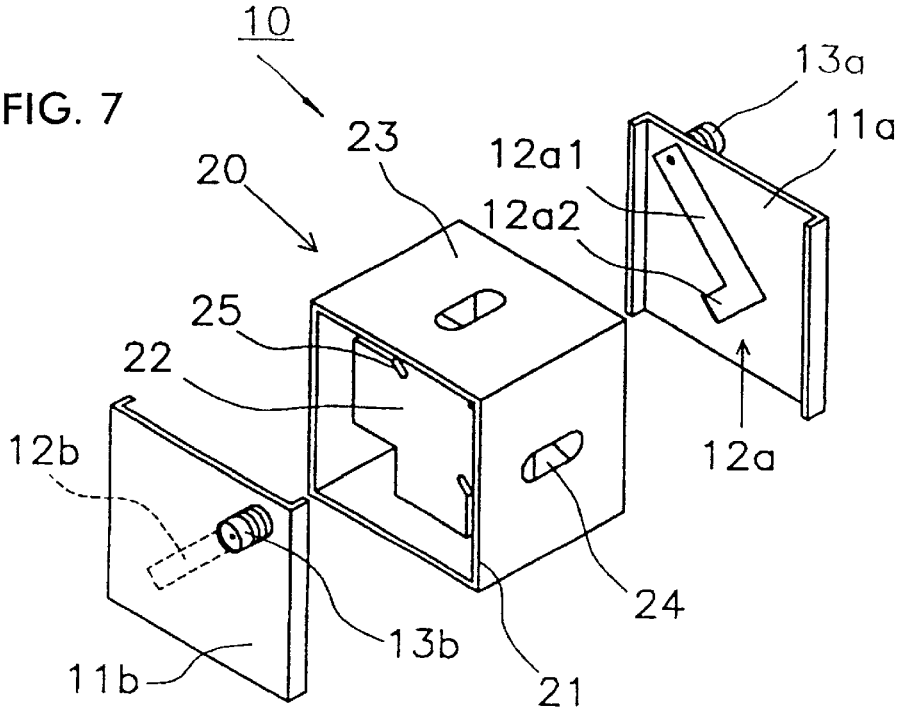
FIG. 7 is an exploded perspective view showing a configuration of a modified coupling loop in a dielectric filter according to another embodiment of the present invention.

In the embodiment of FIG. 6, the loop 12*a* that provides input/output (I/O) coupling is made from a metallic plate that elongates in one direction, but the present invention is not limited to this. That is, as shown in FIG. 7, the loop 12*a* may be constituted of a first part 12*a*1 that elongates in one direction, and a second part 12*a*2 that elongates in a direction orthogonal to the direction in which the first part 12*a*1 elongates, and is thereby coupled to both the first stage and the third stage.

Figure 8:
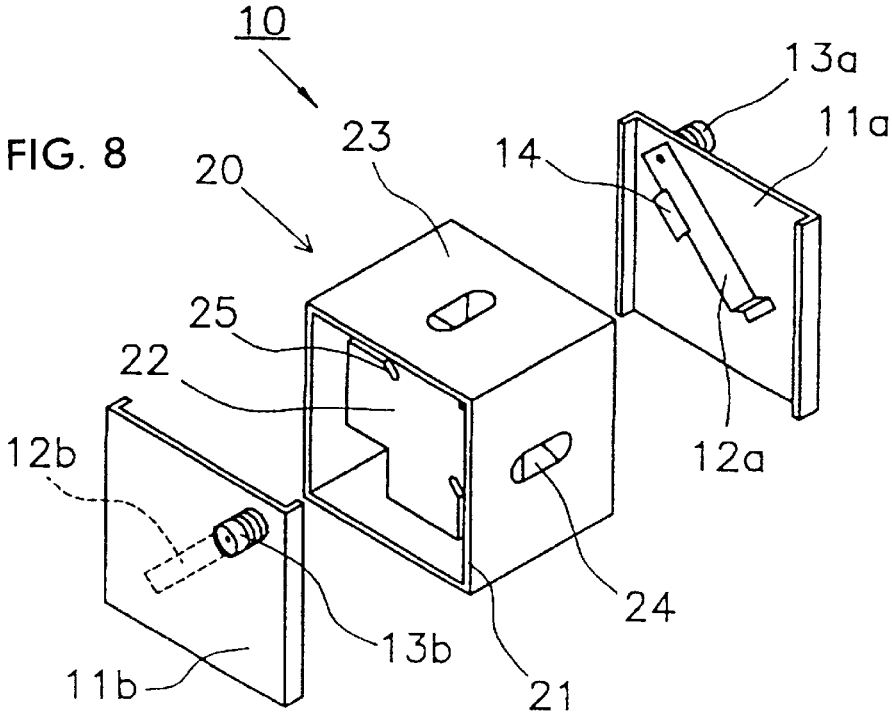
FIG. 8 is an exploded perspective view showing a configuration of another modified coupling loop in a dielectric filter according to yet another embodiment of the present invention.

As another alternative, as shown in FIG. 8, a metallic piece 14 may be mounted to the loop 12*a,* and the coupling degree may be adjusted according to a location or a tilt of that metallic piece 14.

Figure 9:
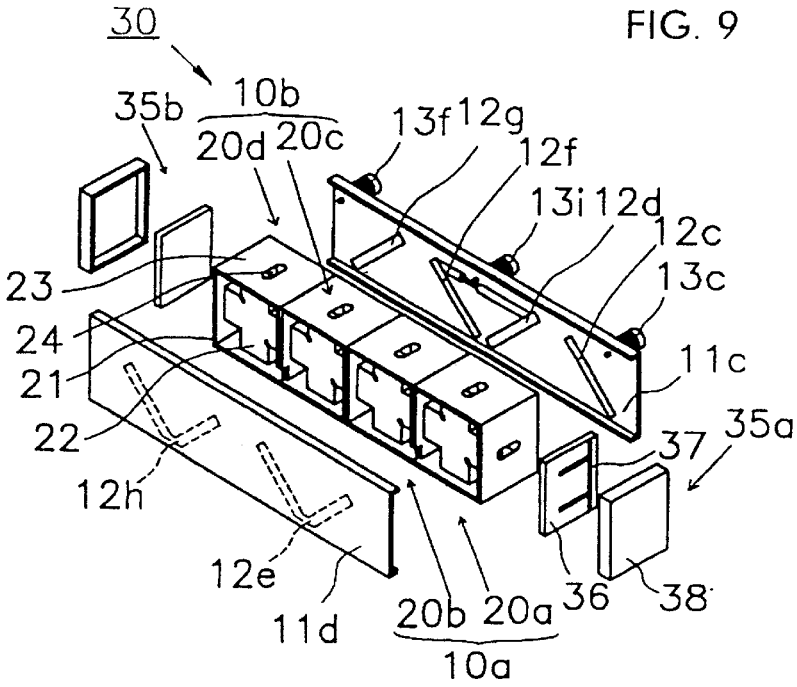
FIG. 9 is an exploded perspective view of a dielectric duplexer according to an embodiment of the present invention.

In the following, a dielectric duplexer that is an embodiment of the present invention will be described with reference to FIG. 9. FIG. 9 is an exploded perspective view of the dielectric duplexer of the present embodiment, and the same symbols are used for the same parts as the ones in the previous embodiment, and the descriptions of those parts are omitted.

As shown in FIG. 9, the dielectric duplexer 30 of the present embodiment is constituted of a filter 10*a* for use in transmitting composed of two dielectric resonators 20*a,* 20*b,* and a filter 10*b* for use in receiving composed of two dielectric resonators 20*c,* 20*d.* Furthermore, the band rejection filters (BRF) 35*a,* 35*b* are connected to the filter 10*a* for use in transmitting, and the filter 10*b* for use in receiving, respectively. Two dielectric resonators 20*a,* 20*b* having a predetermined resonant frequency that is used for the filter 10*a* for use in transmitting, and two dielectric resonators 20*c,* 20*d* having a resonant frequency that is different from a resonant frequency of the filter 10*a* for use in transmitting that is used for the filter 10*b* for use in receiving are arranged in parallel in such a manner that the openings of the cavities 21 are directed in the same direction. Then, the metallic panels 11*c,* 11*d* are mounted to the openings of the cavities 21 of the dielectric resonators 20*a*~20*d,* respectively, and the coaxial connectors 13*c,* 13*f* for connecting to external circuits for use in transmitting and to external circuits for use in receiving and the coaxial connector 13*i* for connecting to an antenna are mounted to the metallic panel 11*c,* respectively.

The band rejection filters 35*a,* 35*b* are each formed by a micro-strip line 37 that is formed on a dielectric substrate 36, and are disposed within the sealed case 38, and are mounted to both end parts of the dielectric resonators 20*a,* 20*d* arranged in parallel. Then one end of the micro-strip line 37 is connected to a central conductor for the coaxial connector 13*c* for connecting to the circuit for use in transmitting, and to a central conductor of the coaxial connector 13*f* for connecting to the circuit for use in receiving, respectively. Furthermore, the dielectric duplexer 30 is stored in a metallic case (not shown herein), for reinforcing the parts of the dielectric resonators 20*a*~20*d.*

The two dielectric resonators 20*a,* 20*b* that constitute the filter 10*a* for use in transmitting are resonators having three resonant modes, respectively, and function as a band pass filter with a total of six stages, and the two dielectric resonators 20*c,* 20*d* that constitute the filter 10*b* for use in receiving also function similarly, as a band pass filter with a total of six stages. To the one metallic panel 11*c,* the loop 12*c* to be coupled to the resonant modes at the first and the third stages of the filter 10*a* for use in transmitting, and the loop 12*d* to be coupled to the resonant modes at the fourth and the sixth stages are mounted. Similarly, the loop 12*f* to be coupled to the resonant modes at the first and the third stages of the filter 10*b* for use in receiving, and the loop 12*g* to be coupled to the resonant modes at the fourth and the sixth stages are mounted. To the other metallic panel 11*d,* the loop 12*e* for use in coupling that is to be coupled to the resonant mode at the third stage of the filter 10*a* for use in transmitting, and further coupled to the resonant mode at the fourth stage is mounted. Similarly, the loop 12*h* for use in coupling that is to be coupled to the resonant mode at the third stage of the filter 10*b* for use in receiving, and further coupled to the resonant mode at the fourth stage is mounted.

One end of the loop 12*c* that is coupled to the resonant modes at the first and the third stages of the filter 10*a* for use in transmitting is connected to one end of the micro-strip line 37 of the band rejection filter 35*a,* and similarly, one end of the loop 12*g* that is coupled to the resonant modes at the fourth and the last stages of the filter 10*b* for use in receiving is also connected to one end of the micro-strip line 37 (not shown) of the band rejection filter 35*b.* Further, the loop 12*d* that is coupled to the resonant modes at the fourth and the sixth stages of the filter 10*a* for use in transmitting, and the loop 12*f* that is coupled to the resonant modes at the first and the third stages of the filter 10*b* for use in transmitting are commonly connected to the central conductor of the coaxial connector 13*i* for connecting to the antenna.

Configured as described above, the filter 10*a* for use in transmitting that is constituted of two dielectric resonators 20*a,* 20*b,* functions as a band pass filter that passes a predetermined frequency, and further two attenuation poles are respectively generated on the low frequency side and the high frequency side of the pass band. Similarly, the filter 10*b* for use in receiving that is constituted of two dielectric resonators 20*c,* 20*d,* functions as a band pass filter that passes a predetermined frequency which is different from the previous frequency, and further two attenuation poles are respectively generated on the low frequency side and the high frequency side of the pass band.

Further, in the present embodiment, the loops 12*c,* 12*d,* 12*f,* 12*g* that are mounted to the one metallic panel 11*c* are used as so-called input/output (I/O) couplings for coupling to two resonant modes in the present invention, by adjusting the mounting angles thereof, etc., as described above. The loops 12*e,* 12*h* that are mounted to the other metallic panel 11*d* may also be used as so-called input/output (I/O) couplings for coupling to two resonant modes in the present invention, by adjusting the mounting angles thereof, etc., as described above.

Moreover, it may be possible to apply the teachings herein to the multi-mode dielectric filters that are proposed in the Japanese Patent Application No. 10-220371 and the Japanese Patent Application No. 10-220372, filed by the applicant of the present application, namely, for example, the hexatic-mode filter having three resonant modes in the TM mode, TE modes, respectively.

Figure 10:
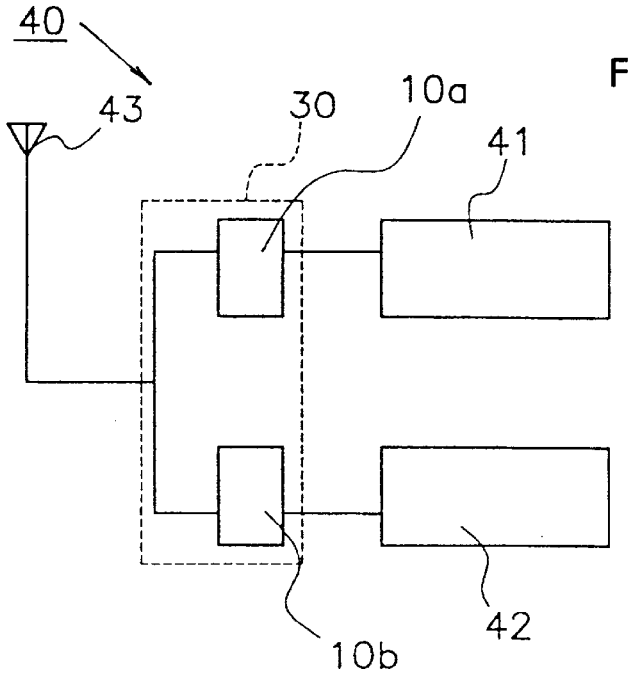
FIG. 10 is a schematic view of a communication device according to an embodiment of the present invention.

In the following, a communication device that is an embodiment of the present invention will be described with reference to FIG. 10. FIG. 10 is a schematic diagram of the communication device of the present embodiment.

As shown in FIG. 10, the communication device 40 of the present embodiment is constituted of a dielectric duplexer 30, a circuit 41 for use in transmitting, a circuit 42 for use in receiving, and an antenna 43. Herein, the dielectric duplexer 30 is a duplexer according to the previous embodiment, and the coaxial connector 13*c* to be connected to the filter 10*a* for use in transmitting in FIG. 9 is connected to the circuit 41 for use in transmitting, and the coaxial connector 13*f* to be connected to the filter 10*b* for use in receiving is connected to the circuit 42 for use in receiving. Further, the coaxial connector 13*i* is connected to the antenna 43.

As described above, according to the present invention, in the dielectric filter constituted of a dielectric resonator having at least three resonant modes and an input/output coupling, the input/output coupling is coupled to the first stage and to the odd numbered stages except the first stage in negative-phase, respectively. Or it is coupled to the last stage and to the odd numbered stages as counted back from the last stage side in negative-phase, respectively. As a result, without using two dielectric resonators, it is possible to provide attenuation poles on both the low frequency side and the high frequency side of the resonant frequency, whereby a dielectric filter having a desirable characteristic can be obtained without making it large.

The invention may be embodied in other specific forms without departing from the spirit or essential characteristics thereof. The present embodiments are therefore to be considered in all respects as illustrative and not restrictive, the scope of the invention including the foregoing description and all changes which come within the meaning and range of equivalency of the claims are therefore intended to be embraced therein.

What is claimed is:

1. A dielectric filter, comprising:

a dielectric resonator having at least three resonant modes, including a conductive cavity, and a dielectric resonator arranged within said cavity; and an input/output coupling that couples to said dielectric resonator, wherein said input/output coupling couples to a resonant mode at a first stage, as well as to at least one resonant mode at an h-th stage (h=2n+1: where n is an integer) approximately in negative-phase with respect to the first stage, among the resonant modes of said dielectric resonator.

2. The dielectric filter as claimed in claim 1, wherein said input/output coupling is a conductive loop, and wherein said input/output coupling is arranged in a direction such that it is coupled approximately in negative-phase with respect to a resonant mode to which said input/output coupling couples.

3. A dielectric filter, comprising:

a dielectric resonator having at least three resonant modes, including a conductive cavity, and a dielectric resonator arranged within said cavity; and an input/output coupling that couples to said dielectric resonator, wherein said input/output coupling couples to a resonant mode at a last stage, as well as to at least one resonant mode at a (k−2n)-th stage (where n is an integer), the last stage being the k-th stage, approximately in negative-phase with respect to the last stage, among the resonant modes of said dielectric resonator.

4. The dielectric filter as claimed in claim 3, wherein said input/output coupling is a conductive loop, and wherein said input/output coupling is arranged in a direction such that it is coupled approximately in negative-phase with respect to a resonant mode to which said input/output coupling couples.

5. A dielectric duplexer, comprising:

two dielectric filters;

an input/output coupling connected to each of said dielectric filters, respectively; and an antenna coupling commonly connected to said two dielectric filters, wherein at least one of said dielectric filters is a dielectric filter comprising:

a dielectric resonator having at least three resonant modes, including a conductive cavity, and a dielectric resonator arranged within said cavity; and an input/output coupling that couples to said dielectric resonator, wherein said input/output coupling couples to a resonant mode at a first stage, as well as to at least one resonant mode at an h-th stage (h=2n+1: where n is an integer) approximately in negative-phase with respect to the first stage, among the resonant modes of said dielectric resonator.

6. The dielectric filter as claimed in claim 5, wherein said input/output coupling is a conductive loop, and wherein said input/output coupling is arranged in a direction such that it is coupled approximately in negative-phase with respect to a resonant mode to which said input/output coupling couples.

7. A dielectric duplexer, comprising:

two dielectric filters;

an input/output coupling connected to each of said dielectric filters, respectively; and an antenna coupling commonly connected to said dielectric filters, wherein at least one of said dielectric filters is a dielectric filter comprising:

dielectric resonator having at least three resonant modes, including a conductive cavity, and a dielectric resonator arranged within said cavity; and an input/output coupling that couples to said dielectric resonator, wherein said input/output coupling couples to a resonant mode at a last stage, as well as to at least one resonant mode at a (k−2n)-th stage (where n is an integer), the last stage being the k-th stage, approximately in negative-phase with respect to the last stage, among the resonant modes of said dielectric resonator.

8. The dielectric filter as claimed in claim 7, wherein said input/output coupling is a conductive loop, and wherein said input/output coupling is arranged in a direction such that it is coupled approximately in negative-phase with respect to a resonant mode to which said input/output coupling couples.

9. A communication device, comprising:

a dielectric duplexer;

a transmitting circuit that is connected to at least one of the input/output couplings of said dielectric duplexer;

a receiving circuit that is connected to the other one of the input/output couplings of said dielectric duplexer;

wherein said dielectric duplexer comprises:

two dielectric filters;

an input/output coupling connected to each of said dielectric filters, respectively; and an antenna coupling commonly connected to said two dielectric filters, wherein at least one of said dielectric filters is a dielectric filter comprising:

a dielectric resonator having at least three resonant modes, including a conductive cavity, and a dielectric resonator arranged within said cavity; and an input/output coupling that couples to said dielectric resonator, wherein said input/output coupling couples to a resonant mode at a first stage, as well as to at least one resonant mode at an h-th stage (h=2n+1: where n is an integer) approximately in negative-phase with respect to the first stage, among the resonant modes of said dielectric resonator.

10. The communication device as claimed in claim 9, wherein said input/output coupling is a conductive loop, and wherein said input/output coupling is arranged in a direction such that it is coupled approximately in negative-phase with respect to a resonant mode to which said input/output coupling couples.

11. A communication device, comprising:

a dielectric duplexer;

a transmitting circuit that is connected to at least one of the input/output couplings of said dielectric duplexer;

a receiving circuit that is connected to the other one of the input/output couplings of said dielectric duplexer;

wherein said dielectric duplexer comprises:

two dielectric filters;

an input/output coupling connected to each of said dielectric filters, respectively; and an antenna coupling commonly connected to said two dielectric filters, wherein at least one of the dielectric filters is a dielectric filter comprising:

a dielectric resonator having at least three resonant modes, as including a conductive cavity, and a dielectric resonator arranged within said cavity; and an input/output coupling that couples to said dielectric resonator, wherein said input/output coupling couples to a resonant mode at a last stage, as well as to at least one resonant mode at a (k−2n)-th stage (where n is an integer), the last stage being the k-th stage, approximately in negative-phase with respect to the last stage, among the resonant modes of said dielectric resonator.

12. The dielectric filter as claimed in claim 11, wherein said input/output coupling is a conductive loop, and wherein said input/output coupling is arranged in a direction such that it is coupled approximately in negative-phase with respect to a resonant mode to which said input/output coupling couples.

13. The communication device as claimed in claim 9, further comprising an antenna connected to said antenna coupling.

14. The communication device as claimed in claim 11, further comprising an antenna connected to said antenna coupling.

* * * * *